United States Patent [19]

Dietrich et al.

[11] Patent Number: 4,847,625

[45] Date of Patent: Jul. 11, 1989

[54] WIDEBAND, APERTURE-COUPLED MICROSTRIP ANTENNA

[75] Inventors: Fred J. Dietrich, Palo Alto; Chich-Hsing A. Tsao, Saratoga; Yeongming Hwang, Los Altos Hills; Francis J. Kilburg, Mountain View, all of Calif.

[73] Assignee: Ford Aerospace Corporation, Newport Beach, Calif.

[21] Appl. No.: 156,259

[22] Filed: Feb. 16, 1988

[51] Int. Cl.[4] ..... H01Q 1/38

[52] U.S. Cl. ..... 343/700 MS; 343/829; H01Q/1/38

[58] Field of Search ..... 343/700 MS File, 829, 343/846

[56] References Cited

U.S. PATENT DOCUMENTS

| | | | |
|---|---|---|---|
| 4,170,013 | 10/1979 | Black | 343/700 MS |
| 4,329,689 | 5/1982 | Yee | 343/700 MS |
| 4,364,050 | 12/1982 | Lopez | 343/700 MS |
| 4,529,987 | 7/1985 | Bhartia et al. | 343/700 MS |
| 4,554,549 | 11/1985 | Fassett et al. | 343/700 MS |
| 4,623,893 | 11/1986 | Sabban | 343/700 MS |

FOREIGN PATENT DOCUMENTS

| | | | |
|---|---|---|---|
| 207029 | 12/1986 | European Pat. Off. . | |
| 2046530 | 11/1980 | United Kingdom | 343/700 MS |
| 2166907A | 9/1985 | United Kingdom | 343/700 MS |

OTHER PUBLICATIONS

Chen et al., "Broadband Two-Layer Microstrip Antenna," *Digest,* 1981, IEEE AP-S International Symposium, pp. 251-254, 1984 (CH2043-8/84).

James et al., *Microstrip Antenna Theory and Design,* IEE, 1981: Peter Peregrinus Ltd., Chapter 10.

Pozar, D. M., "Microstrip Antenna Aperture-Coupled to a Microstripline," *Electronics Letters,* vol. 21, pp. 49-50, Jan. 1985.

I-Ping Yu, "Multiband Microstrip Antenna," *NASA Tech Briefs,* Spring 1980, MSC-18334, Johnson Space Center.

Sabban, A., "A New Broadband Stacked Two-Layered Microstrip Antenna," *Digest,* 1983 IEEE AP-S International Symposium, May 23-26, pp. 63-66 1983 (CH1860-6/83).

*Primary Examiner*—Rolf Hille
*Assistant Examiner*—Michael C. Wimer
*Attorney, Agent, or Firm*—Edward J. Radlo; Kenneth R. Allen; Keith L. Zerschling

[57] ABSTRACT

A wideband, aperture-coupled microstrip antenna comprising a multilayer structure and including a feed layer, a ground plane including an aperture therethrough, a plurality of tuning layers formed of dielectric material, at least one of the tuning layers including therein a tuning element in the form of an electrically-conductive material, herein called a tuning patch, and final radiating layer including a radiating patch. The multiple tuning layers serve to extend the operational bandwidth of the antenna as compared to other microstrip antennas. Aperture coupling allows realization of the antenna using integrated circuit fabication techniques without the shortcoming of direct physical connections between the feedline and the radiator, and thus providing simple, yet reliable coupling between the feedline and the antenna.

7 Claims, 2 Drawing Sheets

WIDEBAND, APERTURE-COUPLED MICROSTRIP ANTENNA

BACKGROUND OF THE INVENTION

The present invention relates to microstrip antenna structures and more specifically to a microstrip antenna having wide bandwidth characteristics (greater than about 20% with a VSWR of 2:1 or less) and which employs slot, i.e., aperture coupling.

The use of microstrip techniques to construct microwave antennas has recently emerged as a consequence of the need for increased miniaturization, decreased cost and improved reliability. One primary application of high interest is in the construction of large phased array systems.

However, microstrip antennas have heretofore suffered from relatively narrow operational bandwidth, which limits tunability of the devices. It is desirable to have an antenna having at least as great a bandwidth as the feed system. And it is in general desirable to have devices with as wide a bandwidth as possible for various wideband applications.

The following references were uncovered in relation to the subject invention:

Pozar, D.M., "Microstrip Antenna Aperture-Coupled to a Microstripline," *Electronics Letters,* Vol. 21, pp. 49–50, January 1985, describes an aperture coupling technique for feeding a microstrip antenna. While the basic aperture feed technique appears similar to that of the subject invention, there is no suggestion of how to achieve a wide continuous bandwidth.

Yee, U.S. Pat. No. 4,329,689 describes a microstrip antenna structure having stacked microstrip elements. However, a second type of coupling is employed. The coupling is a direct, mechanical connection. A central conductor extends from the ground plane directly to the uppermost conducting plane which serves as a radiator. Because there is a central conductor extending through the multiple layers, the center conductor presents an inductance which contributes to detuning effects, an undesirable characteristic. Physical connection such as soldering is required to secure the feed electrically to the conducting plane. Couplings which rely on physical connection are subject to undesired mechanical failure. No provision is shown or suggested for continuous wideband operation.

Fassett et al., U.S. Pat. No. 4,554,549 describes a microstrip antenna with a third type of feed. therein a feedline and a radiating element, a ring, are on the same side of a ground plane. As a consequence, there is a possibility that undesired or stray radiation patterns may be generated from the feedline.

Black, U.S. Pat. No. 4,170,013 describes an antenna with a stripline feed, rather than a microstrip feed. The stripline is sandwiched between two ground planes and directly connected to a radiating patch. The radiating patch in turn radiates through an aperture. The aperture must be larger than the radiating patch. The device is basically a stripline structure.

Bhartia, U.S. Pat. No. 4,529,987 describes a microstrip antenna having a bandwidth broadening feature in the form of a pair of varactor diodes. Physical connection of the diodes is required to electrically couple between the radiator and the ground plane.

Lopez, U.S. Pat. No. 4,364,050 describes a microstrip antenna wherein the radiating elements are cross-slots in a conducting sheet sandwiched between a vertical feed network and a horizontal feed network. Interference may result in the radiation pattern because of blockage and feed network radiation.

I-Ping Yu, "Multiband Microstrip Antenna," *NASA Tech Briefs,* Spring 1980, MCS-18334, Johnson Space Center, describes a multiband, narrow bandwidth microstrip antenna having a direct physical connection between radiating elements and a pin feed attached to a coaxial connector. No provision is made for providing continuous wide-bandwidth operation.

Sabban, A., "A New Broadband Stacked Two-layer Microstrip Antenna," *Digest,* 1983 IEEE AP-S International Symposium, May 23–26, pp. 63–66, 1983 (CH1860-6/83) describes still another microstrip antenna which employs a direct feed. The design described is said to have a continuous bandwidth of 9–15 percent. However, the microstrip feedline resides on the same surface as the "feeder element" and is in direct connection with patches, a different configuration as compared to the present invention.

Chen et al., "Broadband Two-layer Microstrip Antenna," *Digest,* 1981 IEEE AP-S International Symposium, pp. 251–254, 1984 (CH2043-8/84) describes still another microstrip antenna with a direct feed. A probe, which is typically the center conductor of a coaxial cable is connected as by soldering to a first patch near the ground plane. As such, the physical connection is subject to failure, and the probe presents an effective inductance which contributes to detuning effects.

James et al., *Microstrip Antenna Theory and Design,* IEE, 1981: Peter Peregrinus Ltd., Chapter 10 (on trends and future developments) illustrates various schemes for a patch antenna. Of particular note is FIG. 10.18 on page 274, which shows a slot aperture. Significantly, there is no structure above the ground plane wherein the slot resides. The feed method is such that the aperture itself serves as a radiator, and is thus a slot antenna rather than an aperture antenna.

United Kingdom Patent Application No. GB 2,166,907 A describes still another microstrip antenna in which there is a direct coupling to a radiating element. Therein the device is tuned without significantly affecting bandwidth by painting coatings of a dielectric across the radiating surface. This is a fabrication technique for producing a pretuned conventional narrow bandwidth microstrip antenna.

What is needed is a microstrip antenna having a physically-robust coupling and which is capable of wideband operation.

SUMMARY OF THE INVENTION

According to the invention there is provided a wideband, aperture-coupled microstrip antenna comprising a multilayer structure and including a feed layer, a ground plane including an aperture therethrough, a plurality of tuning layers formed of dielectric material, at least one of the tuning layers including therein a tuning element in the form of an electrically-conductive material, herein called a tuning patch, and a final radiating layer including a radiating patch. The multiple tuning layers serve to extend the operational bandwidth of the antenna as compared to other microstrip antennas. Aperture coupling allows realization of the antenna using integrated circuit fabrication techniques without the shortcoming of direct physical connections between the feedline and the radiator, and thus providing simple, yet reliable coupling between the feedline and the antenna.

The invention will be better understood by reference to the following detailed description in connection with the accompanying drawings.

DETAILED DESCRIPTION OF SPECIFIC EMBODIMENTS

Figure 1:
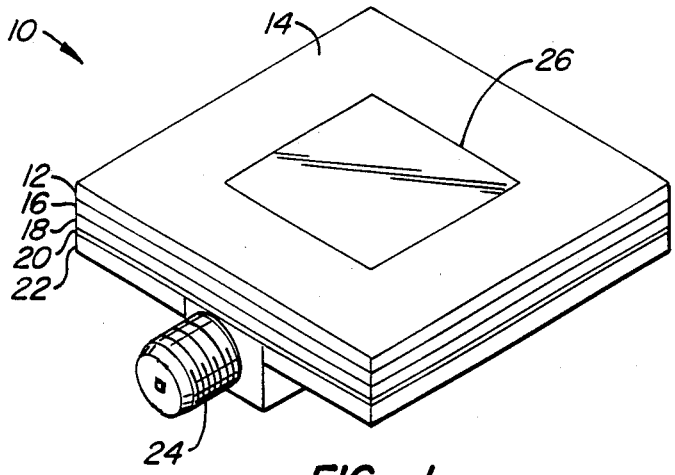
FIG. 1 is a perspective view of a microstrip antenna in accordance with the invention.

Referring now to FIG. 1, there is shown a perspective view of a microstrip antenna 10 in accordance with the invention. The antenna described herein is practical for application at frequencies between about 1 GHz and 20 GHz. However, there is no theoretical limit based on principle. Above about 20 GHz, however, microstrip antennas in general exhibit high losses. Below 1 GHz, wire antennas are more practical because of the large size of antenna needed.

The microstrip antenna 10 comprises a plurality of layers according to the invention, selected ones of the layers contributing to the functions of feed, coupling, impedance matching, radiation, and bandwidth broadening. It is to be understood that the layers of the antenna are generally planar.

As shown in FIG. 1, there is a radiating layer 12 having one side 14 exposed to free space, selected intermediate layers 16, 18 as hereinafter explained, a ground plane 20 of no significant thickness, and a feed layer 22. Connected on one side of the feed layer 22 is a feed (not shown) connected to a feedline connector 24. The feedline connector 24 may be a standard coaxial SMA-type connector suited to the operating frequencies of interest. The radiating layer 12 has imbedded therein an electrically-conductive radiating element formed of a material (suitable for supporting electrical currents), herein referred to as a radiating patch 26. The radiating patch 26 may be a square, rectangle or circle. In the preferred embodiment, the radiating patch is preferably square-shaped with no apertures therethrough. the radiating patch 26 is coupled to the feed, as hereinafter explained, for radiating microwave energy applied through the feed, or reciprocally, for receiving microwave signals and coupling those signals to the feed.

Figure 2:
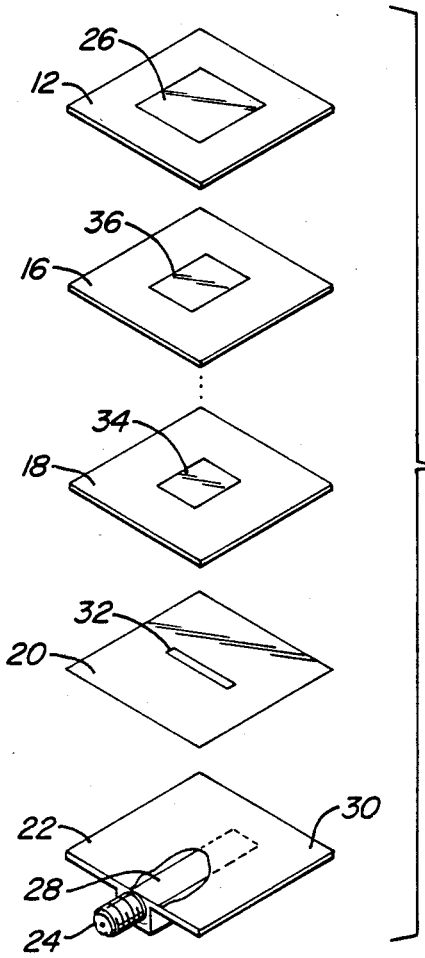
FIG. 2 is an exploded view of a preferred embodiment of a microstrip antenna according to the invention.

Referring to FIG. 2, there is shown an exploded view of the antenna 10 of FIG. 1 according to the invention. The feed layer 22 has a feed 28 on the surface thereof in the form of a strip of electrically-conductive material attached to the center conductor of the feedline connector 24. The feed layer 22, as well as the intermediate layers 16 and 18 and the radiating layer 12 may be constructed of a dielectric material suited to operation in the environment of interest, such as a high-density foam or of a standard dielectric material sold under the registered trademark of RT/DUROID of Rogers Corporation of Rogers, Conn. The DUROID material is known to be available with a dielectric constant in the range of about 2.2 to about 10.6. Other materials are also useful in accordance with the invention so long as dielectric losses are minimized at the frequencies of interest and other mechanical criteria are satisfied. RT/DUROID material is available with copper cladding on one or both sides. The feed layer 22 according to the invention is advantageously constructed of double-cladded RT/DUROID material wherein the first side is an etched strip to form a feedline which is electrically coupled to the feedline connector 24, and the cladding of the opposing second side 30 is actually the ground plane 20.

In accordance with the invention, an aperture 32 is provided in the ground plane 20 as part of the electromagnetic coupling to the radiating patch 26, as explained hereinafter in greater detail. The aperture 32 is preferably a slot etched from the copper cladding forming the ground plane 20.

Similarly, the intermediate layers 16, 18 and radiating layer 12 may be constructed of RT/DUROID or the like cladded on one side with a conductive layer. The conductive layers are each etched away to leave coupling patches 34, 36 of conductive material, each in a pattern, such as a square, a circle or rectangle, of relatively small thickness. A typical thickness of a patch is 25 microns, whereas a typical intermediate layer thickness is 500 to 1000 microns. While it is possible to construct an antenna with aperture coupling without intermediate layers by providing a radiating layer 12 of significantly greater thickness than 1000 microns and thereby increasing the bandwidth, it is not possible to achieve the desired wide bandwidth operation in accordance with the invention. Moreover, a radiating layer having a thickness which is of any significant percentage of the wavelengths of interest will inhibit effective aperture coupling and may well allow excitation of undesired surface waves. In accordance with the invention, therefore, intermediate layers are provided whereupon one or more coupling patches 34, 36 is provided between the radiating patch 26 and the aperture 32 in the ground plane 20. At least one such intermediate coupling patch 34 of minimal thickness is needed to provide the desired broadband tuning and energy coupling across the separation between the radiating patch 26 and the aperture 32.

The number and thickness of the intermediate layers 16, 18 are selected in accordance with design specifications respecting the desired bandwidth characteristics of the antenna 10. The greater the separation imposed by the substrates, the broader the operational bandwidth. However, at a frequency of about 20 GHz, it is recommended that the maximum separation between conductive layers, including the ground plane and the radiating patch, not exceed about 1000 microns.

Alternative structures are contemplated. An equivalent structure to one having one intermediate layer of 1000 micron thickness is two sandwiched intermediate layers of identical materials of 500 micron thickness each wherein the interface contains no intermediate patch. Intermediate layers of different dielectric materials might also be employed to achieve variations in the dielectric characteristics in the axial direction. Dielectric materials having a dielectric characteristic might also be used as for example to construct antennas having integrated focussing elements. Layers of material (not shown) may also be applied over the radiating patch 26, either for protection or for matching with the impedance of free space. Still other operations will occur to those of ordinary skill in this art.

Figure 3:
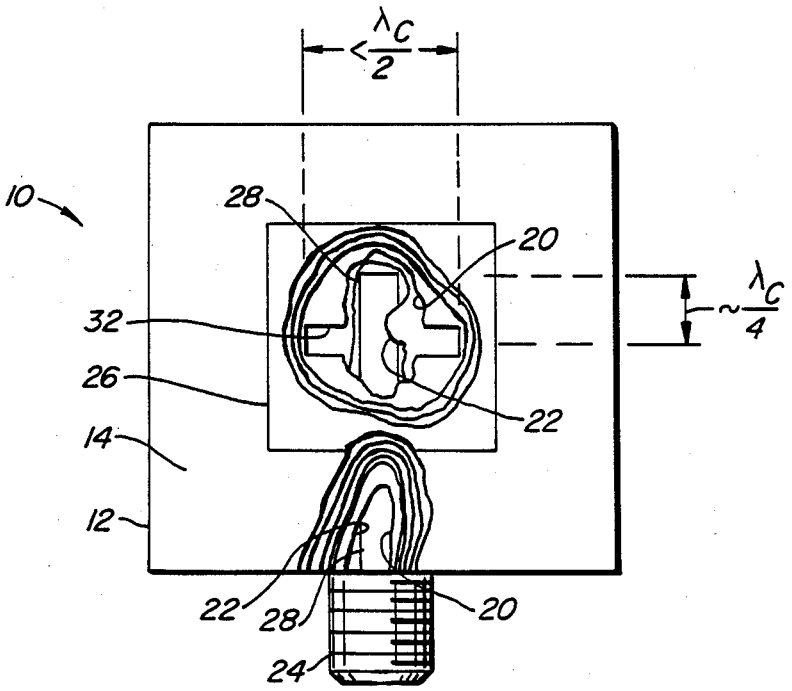
FIG. 3 is a top plan view in partial cutaway of a specific embodiment of the invention.

Referring to FIG. 3, there is shown a top plan view of a specific embodiment of an antenna 10 according to the invention for illustrating one type of aperture coupling.

The numerals refer to the structural elements described hereinabove. Preferably, the aperture 32 is a slot having a maximum dimension transverse to the feed 28 and disposed midway between the margins of the radiating patch 26 when viewed along the axis of the intended radiating pattern. The preferred maximum slot length is less than one-half the wavelength at the nominal center frequency of intended operation. In this configuration, it is also preferred that the feed 28 extend across the slot aperture 32 about one-quarter wavelength at the center frequency. More precisely, the feed 28 extends less than one-quarter wavelength but greater than one-eighth wavelength. Preferably, the feed 28 is slightly less than one-quarter wavelength in the preferred embodiment. It is contemplated that feeds of other lengths might be employed without departing from the scope and spirit of the invention. The length from the connector 24 is not a critical dimension. The extension of the feed 28 past the aperture, as well as the width of the feed 28, is selected for best input impedance matching of the antenna 10.

While the system has been described in order to illustrate the preferred embodiments, variations and modifications to the herein described system within the scope of the invention, would undoubtedly suggest themselves to those skilled in the art. Accordingly, the foregoing description should be taken merely as illustrative and the invention should be limited only in accordance with the accompanying claims.

We claim:

1. A wideband microwave-frequency microstrip antenna of a structure permitting selection of antenna bandwidth by preselection of fixed spacing between planar elements comprising:

a planar feed layer having a feed line in the form of a microstrip line with a single ground plane, said single ground plane being disposed between said planar feed layer and a radiating element, said feed line connected to a microwave signal feed;

a plurality of planar tuning layers formed of dielectric materials, a first one of said tuning layers being juxtaposed upon said planar feed layer, said tuning layers being juxtaposed to one another, at least one of said tuning layers including therein an electrically conductive sheet element disposed parallel to said planar feed layer, the number, composition and thickness of said tuning layers being preselected to establish an antenna bandwidth;

said ground plane including an aperture therein and disposed between said plurality of tuning layers and said feed layer, said aperture being a slot in said ground plane disposed perpendicular to said feed line and selectively positioned along said planar feed layer, said feed line extending across said slot, from one edge of said slot and beyond an opposite edge of said slot to effect electromagnetic coupling through said slot between said sheet element and said feed line; and a planar radiating layer on a first side thereof mounted to one of said tuning layers and on a second side thereof opposing said first side, directing said planar radiating layer toward free space, said planar radiating layer including therein an electrically conductive radiating element.

2. The antenna according to claim 1 wherein said slot has a linear dimension across said planar feed layer less than one-half wavelength of a design center frequency of operation of said antenna.

3. The antenna according to claim 2 wherein said slot is disposed midway between margins of said conductive radiating element.

4. The antenna according to claim 1 wherein said slot has a linear dimension less than one-half wavelength of a design center frequency of operation of said antenna and wherein said feed line extends less than one-quarter wavelength and greater than one-eighth wavelength across said slot at said design center frequency of operation of said antenna.

5. The antenna according to claim 4 wherein said slot is disposed midway between lateral margins of said conductive radiating element.

6. A wideband microwave-frequency microstrip antenna of a structure permitting selection of antenna bandwidth by preselection of fixed spacing between planar elements comprising:

a planar feed layer having a feed line in the form of a microstrip line with a single ground plane, said single ground plane being disposed between said planar feed layer and a radiating element, said feed line connected to a microwave signal feed;

a plurality of planar tuning layers formed of dielectric materials, a first one of said tuning layers being juxtaposed upon said planar feed layer, said tuning layers being juxtaposed to one another, at least one of said tuning layers including therein an electrically conductive sheet element disposed parallel to said planar feed layer, the number, composition and thickness of said tuning layers being preselected to establish an antenna bandwidth;

said ground plane including an aperture therein and disposed between said plurality of tuning layers and said feed layer, said aperture being a slot in said ground plane disposed transverse to said feed line and selectively positioned along said planar feed layer to effect electromagnetic coupling through said slot between said sheet element and aid feed line; and a planar radiating layer on a first side thereof mounted to one of said tuning layers and on a second side thereof opposing said first side, directing said planar radiating layer toward free space, said planar radiating layer including therein an electrically conductive radiating element, wherein said slot has a linear dimension less than one-half wavelength of a design center frequency of operation of said antenna and wherein said feed line extends less than one-quarter wavelength and greater than one-eighth wavelength across said slot at said design center frequency of operation of said antenna.

7. The antenna according to claim 6 wherein said slot is disposed midway between margins of said conductive radiating element.

* * * * *

UNITED STATES PATENT AND TRADEMARK OFFICE

CERTIFICATE OF CORRECTION

PATENT NO. : 4,847,625

DATED : July 11, 1989

INVENTOR(S) : Tsao et al.

It is certified that error appears in the above-identified patent and that said Letters Patent is hereby corrected as shown below:

On the title page, item 19, "Dietrich et al" should read --Tsao et al--.

On page 1, at [75], please correct the order in which the inventors are listed as indicated below:

Chich-Hsing A. Tsao, Saratoga, California
Yeongming Hwang, Los Altos Hills, California
Francis J. Kilburg, Mountain View, California
Fred J. Dietrich, Palo Alto, California

Signed and Sealed this

Seventeenth Day of April, 1990

*Attest:*

HARRY F. MANBECK, JR.

*Attesting Officer*

*Commissioner of Patents and Trademarks*